US008282584B2

(12) United States Patent
Tsukada et al.

(10) Patent No.: US 8,282,584 B2
(45) Date of Patent: Oct. 9, 2012

(54) MASSAGE CHAIR

(75) Inventors: Daisuke Tsukada, Hikone (JP); Masamichi Miyaguchi, Hikone (JP); Fumihiro Nishio, Hikone (JP); Yuichi Nishibori, Hikone (JP); Takayoshi Tanizawa, Shiga (JP); Takeo Iijima, Hikone (JP)

(73) Assignee: Panasonic Corporation, Osaka (JP)

( * ) Notice: Subject to any disclaimer, the term of this patent is extended or adjusted under 35 U.S.C. 154(b) by 1290 days.

(21) Appl. No.: 11/569,522

(22) PCT Filed: May 30, 2005

(86) PCT No.: PCT/JP2005/009876

§ 371 (c)(1),
(2), (4) Date: Mar. 1, 2007

(87) PCT Pub. No.: WO2005/115301

PCT Pub. Date: Dec. 8, 2005

(65) Prior Publication Data

US 2007/0225624 A1 Sep. 27, 2007

(30) Foreign Application Priority Data

May 28, 2004 (JP) ..... 2004-160026

(51) Int. Cl.
*A61H 7/00* (2006.01)
*A61H 19/00* (2006.01)

(52) U.S. Cl. ..... 601/98; 601/90

(58) Field of Classification Search ..... 601/24, 601/49, 84, 86, 90, 91, 98, 115
See application file for complete search history.

(56) References Cited

U.S. PATENT DOCUMENTS

| | | | |
|---|---|---|---|
| 6,117,094 | A | 9/2000 | Fujii |
| 6,832,991 | B1 | 12/2004 | Inada et al. |
| 2005/0137504 | A1 | 6/2005 | Yano et al. |
| 2005/0146176 | A1 | 7/2005 | Yoda et al. |
| 2006/0111653 | A1 | 5/2006 | Nishio et al. |

FOREIGN PATENT DOCUMENTS

| | | |
|---|---|---|
| EP | 1145700 | 10/2001 |

(Continued)

OTHER PUBLICATIONS

English language Abstract of JP 2003-70857.

(Continued)

*Primary Examiner* — Kristen Matter
(74) *Attorney, Agent, or Firm* — Greenblum & Bernstein P.L.C.

(57) ABSTRACT

A massage chair is adapted to give a massage to a user using a massaging element attached to a massaging unit. The massage chair comprises a body-shape-information acquisition section for acquiring body-shape information of the user based on loads imposed on the massaging element from respective regions of the user, a shoulder-position detection section for detecting a shoulder position of the user based on the body-shape information, and a shoulder-position identification section. The shoulder-position identification section is operable to thrust the massaging element in a direction for a target protrusion distance at the detected shoulder position while measuring a load imposed on the massaging element. Then, the shoulder-position identification section is operable, based on the measured load, to determine whether the detected shoulder position is a true shoulder position. Further, when the detected shoulder position is determined to be mismatched with the true shoulder position, the shoulder-position identification section is operable to vertically move the massaging unit while re-measuring a load imposed on the massaging element, so as to identify the true shoulder position based on the re-measured load.

4 Claims, 8 Drawing Sheets

FOREIGN PATENT DOCUMENTS

| | | |
|---|---|---|
| JP | 5-31147 | 2/1993 |
| JP | 5-161682 | 6/1993 |
| JP | 6-190012 | 7/1994 |
| JP | 10-243982 | 9/1998 |
| JP | 2001-120619 | 5/2001 |
| JP | 2001-238927 | 9/2001 |
| JP | 2003-52780 | 2/2003 |
| JP | 2003-70857 | 3/2003 |
| JP | 2003-325621 | 11/2003 |
| JP | 2004-24911 | 1/2004 |
| JP | 2004-73881 | 3/2004 |
| JP | 2004-73882 | 3/2004 |
| JP | 6-190012 | 7/2004 |
| WO | 01/19315 | 3/2001 |

OTHER PUBLICATIONS

English language Abstract of JP 2003-52780.
English language Abstract of JP 6-190012.
English Language Abstract of JP 2001-120619.

*Fig.5*

| SPECIFIC PROTRUSION VALUE | LOAD VALUE |
|---|---|
| L1 | P1 |
| L2 | P2 |
| L3 | P3 |
| L4 | P4 |
| ⋮ | ⋮ |
| L | P |

*Fig.6*

| SPECIFIC PROTRUSION VALUE | LOAD VALUE FOR EACH PROTRUSION VALUE | (EXAMPLE) | CORRECTIVE MOVEMENT VALUE |
|---|---|---|---|
| L1 | P1 | 10kg | Y1 |
| L2 | P2 | 15kg | Y2 |
| L3 | P3 | 20kg | Y3 |
| L4 | P4 | 25kg | Y4 |
| L5 | P5 | 30kg | Y5 |
| L6 | P6 | 35kg | Y6 |
| L7 | P7 | 40kg | Y7 |
| L8 | P8 | 45kg | Y8 |
| L9(L) | P9(P) | 50kg | Y9 |

MASSAGE CHAIR

BACKGROUND OF THE INVENTION (1) Field of the Invention

The present invention relates to a technique for automatically detecting an exact position of the shoulder of a massage recipient or user seated in a massage chair.

(2) Description of the Related Art

There has heretofore been known a massage chair adapted to measure a body shape of a message recipient or user seated therein, just before giving massage to the user using a massaging element, and then perform a massage operation based on the measured body-shape information of the user.

This type of massage chair is designed, for example, as follows. In advance of a massage operation, the massaging element is moved from a waist region toward a head region (from a lower region to an upper region) of a user seating in the massage chair while pressing the massaging element onto the user's back, to measure loads imposed on the massaging element in respective regions of the user. Then, body-shape information of the user is acquired based on the measured loads, and shoulder-position information is acquired based on the acquired body-shape information to detect a should position.

However, if the user adjusts his/her seating position or changes his/her posture during or just after the body-shape measurement, body-shape information or shoulder-position information acquired by the massage chair will likely deviate from an actually body shape or shoulder position of the user.

In view of this problem, the following Patent Publication 1 discloses a massage chair adapted to allow a deviation between an actual body shape or shoulder position of a user and body-shape information or shoulder-position information acquired by the massage chair to be manually adjusted.

Further, the following Patent Publication 1 discloses a massage chair adapted to detect a shoulder position of a user and then re-detect the shoulder position during a massage operation, such as rolling massage.

Patent Publication 1: JP 2003-052780 A

Patent Publication 2: JP 2003-070857 A

BRIEF SUMMARY OF THE INVENTION

The conventional massage chair disclosed in the Patent Publication 1 has a problem about a burden imposed on a user for manually performing the deviation adjustment. While a massage chair is originally intended to offer relaxation to a user, such a burdensome adjustment is undesirable in view of its intended purpose of offering relaxation.

The conventional massage chair disclosed in the Patent Publication 2 is designed to re-detect the shoulder position during a massage operation. Thus, the massage operation before the re-detection is likely to be performed based on inexact shoulder-position information detected in advance of the massage operation.

The present invention has been made to solve the above conventional problems, and its object is to provide a massage chair capable of automatically identifying a shoulder position exactly in a simplified manner.

In order to achieve the above object, a massage chair of the present invention is adapted to give a massage to a user using a massaging element attached to a vertically movable massaging unit. The massage chair comprises a body-shape-information acquisition section for acquiring body-shape information of the user based on loads imposed on the massaging element from respective regions of the user when the massaging unit is vertically moved (each of these loads will hereinafter be referred to as "massaging-element load"), a shoulder-position detection section for detecting a shoulder position of the user based on the body-shape information, and a shoulder-position identification section. The shoulder-position identification section is operable to thrust the massaging element in a direction for a target protrusion distance at the shoulder position detected by the shoulder-position detection section (hereinafter referred to as "detected shoulder position"), while measuring a massaging-element load. Then, the shoulder-position identification section is operable, based on the measured massaging-element load, to determine whether the detected shoulder position is a true (proper) shoulder position. Further, when the detected shoulder position is determined to be mismatched with the true shoulder position, the shoulder-position identification section is operable to vertically move the massaging unit while re-measuring a massaging-element load, so as to identify the true shoulder position based on the re-measure massaging-element load.

In the above massage chair, when a detected shoulder position is determined to be matched with the true shoulder position, the detected shoulder position is identified directly as the true shoulder position. Differently, if the detected shoulder position is determined to be mismatched with the true shoulder position, the massaging unit will be vertically moved while re-measuring a massaging-element load, so as to identify the true shoulder position based on the re-measure massaging-element load. In this manner, a shoulder position is identified through the second operation adapted to be performed successively after the body-shape acquisition operation. This makes it possible to automatically identify a shoulder position exactly in a simplified manner.

In the massage chair of the present invention, the shoulder-position identification section may be designed to continuously thrust the massaging element in the direction for the target protrusion distance at the detected shoulder position. In this case, in the event that a massaging-element load in the course of the continuous thrust operation reaches a load threshold associated with the target protrusion distance at the true shoulder position (this load will hereinafter be referred to as "target load threshold"), the shoulder-position identification section is preferably operable to move the massaging unit upward while maintaining protrusion distance at the time of the event (this protrusion distance will hereinafter be referred to as "halfway protrusion distance"), and identify, as the true shoulder position, a position where the massaging-element load is lowered to a load threshold associated with the halfway protrusion distance at the true shoulder position.

Thus, in the event that a massaging-element load in the course of the continuous thrust operation reaches the target load threshold, the true shoulder position can be identified in a simplified operation only of moving the massaging unit upward and measuring a position where the massaging-element load is lowered to a load threshold associated with the halfway protrusion distance at the true shoulder position. In addition, the operation of identifying the true shoulder position can be performed in response to the event that a massaging-element load in the course of the continuous thrust operation reaches the target load threshold. This makes it possible to identify the true shoulder position in a stepless or continuous manner and more exactly know the shoulder position of the user seated in the massage chair.

In the massage chair of the present invention, the shoulder-position identification section may be designed to thrust the massaging element in the direction for the target protrusion distance at the detected shoulder position in a multistage manner according to a plurality of specific protrusion distances pre-set such that respective values thereof increase in plural stages and include the target protrusion distance as a maximum value. In this case, in the event that a massaging-element load in the course of the multistage thrust operation exceeds the target load threshold, the shoulder-position identification section may be operable to move the massaging unit upward while maintaining the specific protrusion distance in the stage having the event, and identify, as the true shoulder position, a position where the massaging-element load is lowered to a load threshold associated with the maintained specific protrusion distance at the true shoulder position.

Thus, in the event that a massaging-element load exceeds the target load threshold when the massaging element is thrust by either one of the specific protrusion distances, the true shoulder position can be identified in a simplified operation only of moving the massaging unit upward while maintaining the specific protrusion distance, and measuring a position where the massaging-element load is lowered to a load threshold associated with the maintained specific protrusion distance at the true shoulder position.

In the massage chair of the present invention, the shoulder-position identification section may be designed to thrust the massaging element by each of a plurality of specific protrusion distances in plural stages to be changed from a first stage to a last stage. The plurality of specific protrusion distances are pre-set such that respective values thereof increase in plural staged and include the target protrusion distance as a maximum value. In this case, when a load imposed on the massaging element in a certain one of the stages is equal to or less than a load threshold associated with the specific protrusion distance in the certain stage, the shoulder-position identification section may be operable to thrust the massaging element by the specific protrusion distance in a next one of the stages. Further, in the event that a load imposed on the massaging element in a certain one of the stages exceeds a load threshold associated with the specific protrusion distance in the certain stage, the shoulder-position identification section may be operable to move (or repeatedly move) the massaging unit upward to a position where the load imposed on the massaging element is lowered to the load threshold associated with the specific protrusion distance in the certain stage, and then thrust the massaging element by the specific protrusion distance in a next one of the stage. Then, the shoulder-position identification section is operable to identify, as the true shoulder position, a position where a load imposed on the massaging element thrust by the target protrusion distance is equal to a load threshold associated with the target protrusion distance at the true shoulder position.

Thus, in a process of identifying the true shoulder position through a second shoulder-position detection adapted to be performed successively after a first shoulder-position detection based on the measurement of body-shape information, the second shoulder-position detection is controlled based on a combination of the massaging-element load and the protrusion distance of the massaging element. This makes it possible to more exactly identify a shoulder position.

As above, the massage chair of the present invention is designed to identify the true shoulder position through a first operation of detecting a shoulder position based on body-shape information and a second operation adapted to be performed successively after the first operation to re-detect a shoulder position. This makes it possible to automatically identify the true shoulder position exactly in a simplified manner.

BRIEF DESCRIPTION OF THE SEVERAL VIEWS OF THE DRAWINGS

FIG. 5 is a table showing a relationship between a specific protrusion distance equal to or less than a target protrusion distance and a threshold of a load imposed on the massaging element from a user at the specific protrusion distance, in a massage chair according to a second embodiment of the present invention.

FIG. 6 is a table showing a relationship of a specific protrusion distance equal to or less than a target protrusion distance, a threshold of a load imposed on the massaging element from a user at the specific protrusion distance, and a corrective movement value for a massaging unit, in a massage chair according to a third embodiment of the present invention.

Figure 1:
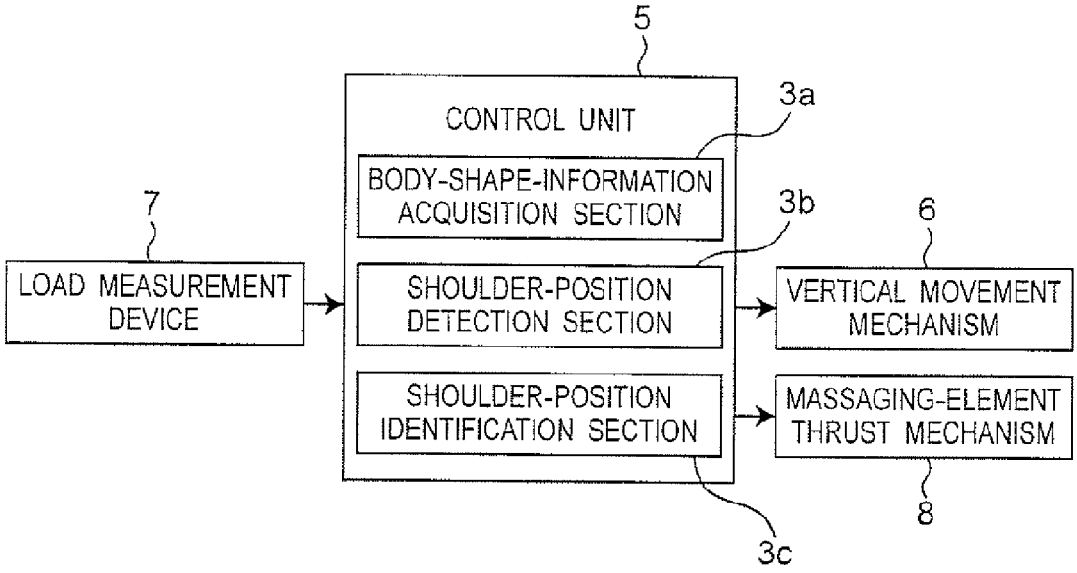
FIG. 1 is a block diagram showing a control system of a massage chair according to a first embodiment of the present invention.

S: Massage chair
M: User
1: Massaging element
2: Massaging unit
3*a*: Body-shape-information acquisition section
3*b*: Shoulder-position detection section
3*c*: Shoulder-position identification section
4: Massaging arm

4*a*: Upper arm
4*b*: Lower arm
5: Control unit
6: Vertical movement mechanism
7: Load measurement device
8: Massaging-element thrust mechanism
10: Chair back

DETAILED DESCRIPTION OF THE INVENTION

This application is based upon and claims the benefit of priority from the prior Japanese Patent Application No. 2004-160026, filed in Japan, the entire contents of which are incorporated herein by reference. With reference to the accompanying drawings, several embodiments of the present invention will now be specifically described. In the accompanying drawings, a common element or component is defined by the same reference numeral or code.

First Embodiment

Figure 3A:
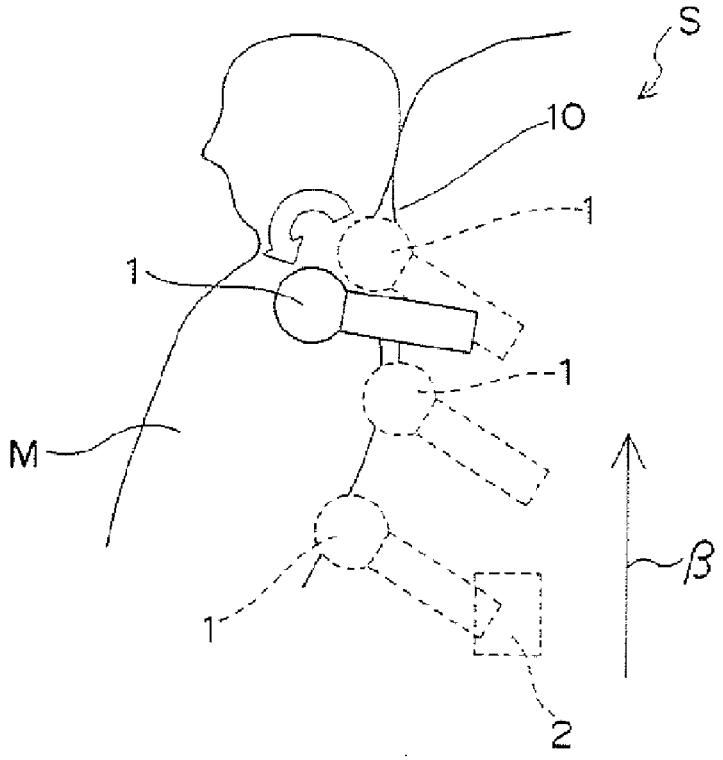
FIG. 3A is a schematic diagram showing the massaging element which is thrust at a shoulder position detected by a first operation, in the first embodiment.

A first embodiment of the present invention will be described below. As shown in FIG. 3A, a massage chair 5 according to the first embodiment comprises a chair cushion (not shown) for allowing a massage recipient or user M to sit thereon, and a chair back 10 for allowing the back of the user M to lean thereagainst. The chair back 10 incorporates a massaging unit 2 adapted to be selectively moved in a vertical direction. The massaging unit 2 is provided with a pair of massaging elements disposed in side-by-side relation along a horizontal direction. The massaging element pair 1 is adapted to be selectively moved relative to the massaging unit 2, in a thrust direction (i.e., a direction extending from the chair back 10 toward the back of the user M, in a direction opposite to the thrust direction (this direction will hereinafter be referred to as "anti-thrust direction") and in a width (lateral) direction of the chair back 10.

This massage chair S is designed such that, during a vertical movement of the massaging unit 2 after the user M sits on the chair cushion and leans his/her back against the chair back 10, operable, the massaging element pair 1 is selectively moved relative to the massaging unit 2, in either one of the thrust direction and the anti-thrust direction. The massage chair S is also designed to allow each of the massaging element pair 1 and the massaging unit 2 to be laterally moved. Further, the massage chair S is designed such that, in a state after the massaging unit 2 is set at an arbitrary vertical position, the massaging element pair 1 is selectively moved relative to the massaging unit 2 in either one of the thrust direction and the anti-thrust direction, and each of the massaging element pair 1 and the massaging unit 2 is laterally moved. In this manner, the massage chair S performs a massage operation to the user M.

Furthermore, as a preparation for the massage operation, the massage chair S is designed to acquire body-shape information of the user M seated in the massage chair S based on loads imposed on respective regions of the user M and identify a shoulder position. In a massage mode, based on the above body-shape information and the shoulder-position information, the massage chair S can automatically perform a massage operation suitable for the body shape and shoulder position of the user M, under control of a control unit 5 (see FIG. 1).

In the massage chair S according to the first embodiment, the operation of identifying a shoulder position in advance of the massage operation is performed as follows. FIG. 1 is a block diagram showing a shoulder-position identification system for identifying a shoulder position. As shown in FIG. 1, the shoulder-position identification system comprises the control unit 5 which includes a body-shape-information acquisition section 3*a*, a shoulder-position detection section 3*b* and a shoulder-position identification section 3*c*, a load measurement device 7 for measuring a load imposed on the massage element pair 1 from the user M, a vertical movement mechanism 6 for vertically moving the massaging unit 2, and a massaging-element thrust mechanism 8 for thrusting the massage element pair 1 relative to the massaging unit 2. The massaging-element thrust mechanism 8 is operable to thrust the massage element pair 1 toward the user M and additionally to retract the massage element pair 1 in the anti-thrust direction.

Figure 2A:
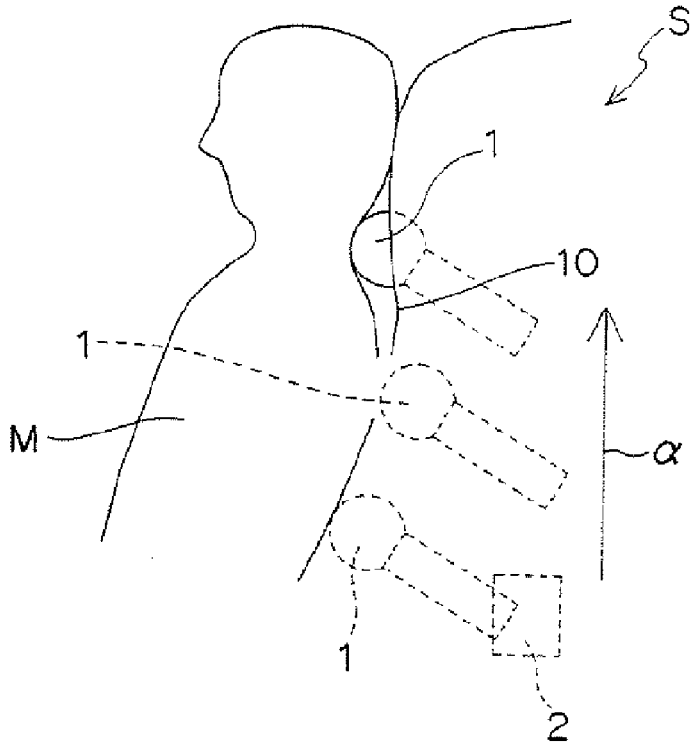
FIG. 2A is a schematic diagram showing a movement of a massaging element in an operation of acquiring body-shape information using the massaging element.

Specifically, as a first operation, in response to pressing a start button (not shown), the massage element pair 1 is pressed onto the waist of lower portion of the back of the user M according to a control signal from the control unit 5. In this state, the vertical movement mechanism 6 moves the massaging unit 2 upward as indicated by the arrow $\alpha$ in FIG. 2. During the upward movement, the load measurement device 7 directly or indirectly measures loads (or pressures) imposed on the massage element pair 1 from respective regions of the user M due to rolling etc., i.e., massage-element loads, and inputs the measured load information into the control unit 5.

Figure 2B:
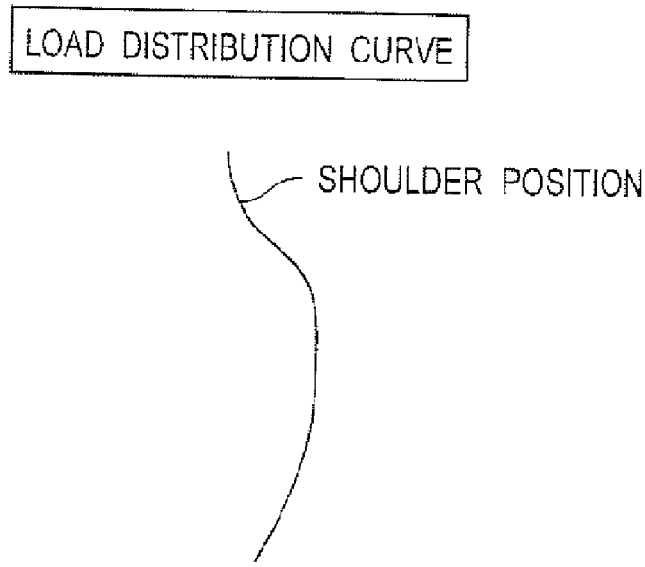
FIG. 2B is a diagram showing a load distribution curve obtained based on the body-shape information acquired through the operation illustrated in FIG. 2A.

In the control unit 5, based on the load information, the body-shape-information acquisition section 3*a* calculates a load distribution curve as shown in FIG. 2B as body-shape information of the user M. Then, based on the load distribution curve, the shoulder-position detection section 3*b* obtains a body shape of the user M. As is clear from FIG. 2B, a shoulder position of the user M can be detected (recognized) by obtaining a body shape of the user M. The above operation is the same as a conventional operation designed to obtain a shoulder position of a user in conjunction with obtaining body-shape information of the user. After the shoulder position is detected based on the body-shape information in the above manner through the first operation, a control signal is output from the control unit 5 to the massaging-element thrust mechanism 8.

Successively, as a second operation, the massaging-element thrust mechanism 8 moves the massage element pair 1 in the thrust direction at the shoulder position detected by the first operation. During the movement of the massage element pair 1 in the thrust direction, the load measurement device 7 measures a load imposed on the massage element pair 1 from the user M. Then, the shoulder-position identification section 3*c* performs a determination on whether the current position is a shoulder position.

In the second operation, when the current position, i.e., the shoulder position detected by the first operation, is also determined as a shoulder position, this position is identified directly as a true shoulder position. Differently, in the second operation, when the shoulder position detected by the first operation is not determined as a shoulder position, a control signal is output from the control unit 5 to the vertical movement mechanism 6. Thus, the vertical movement mechanism 6 vertically moves the massaging unit 2 together with the massage element pair 1 to measure a massage-element load. In the course of the vertical movement, if the massage-element load reaches a target load distribution point, the shoulder-position identification section 3*c* will identify this position as the true shoulder position.

As in the above case, when a shoulder position different from the shoulder position detected by the first operation is identified as the true shoulder position, the previously measured body-shape information is corrected based on the newly identified shoulder-position information. Then, the massage chair S will automatically perform a massage operation under control of the control unit 5 based on identified shoulder-position information and the corrected body-shape information.

In the process of thrusting the massage element pair 1 the measure a massage-element load by the load measurement device 7, a load (or pressure) imposed directly on the massage element pair 1 from the user M may be measured. Alternatively, another state quantity to be changed in response to a load imposed on the massage element pair 1 may be measured, and the measured state quantity may be converted or reduced to a load (or pressure).

In the first embodiment, the massage element pair 1 is rotated relative to the massaging unit 2 in a plane perpendicular to the chair back 10, in such a manner as to be thrust (moved toward the user M) or retracted (moved to a direction away from the user M).

Figure 3B:
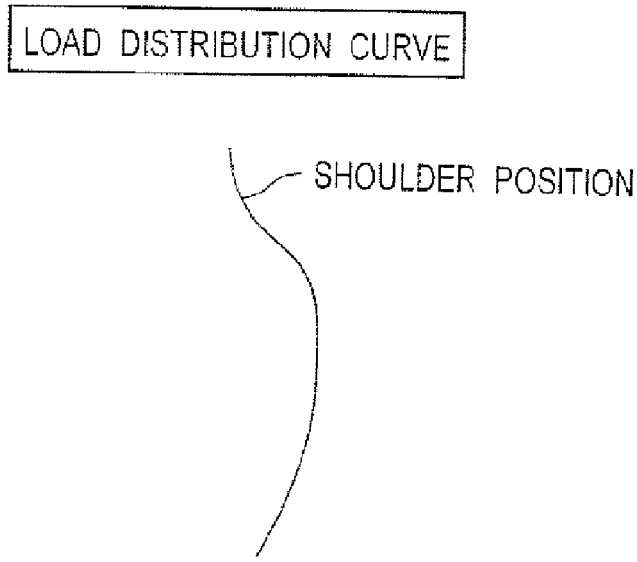
FIG. 3B is a diagram showing a load distribution curve obtained based on body-shape information acquired through the operation illustrated in FIG. 3A.
Figure 4:
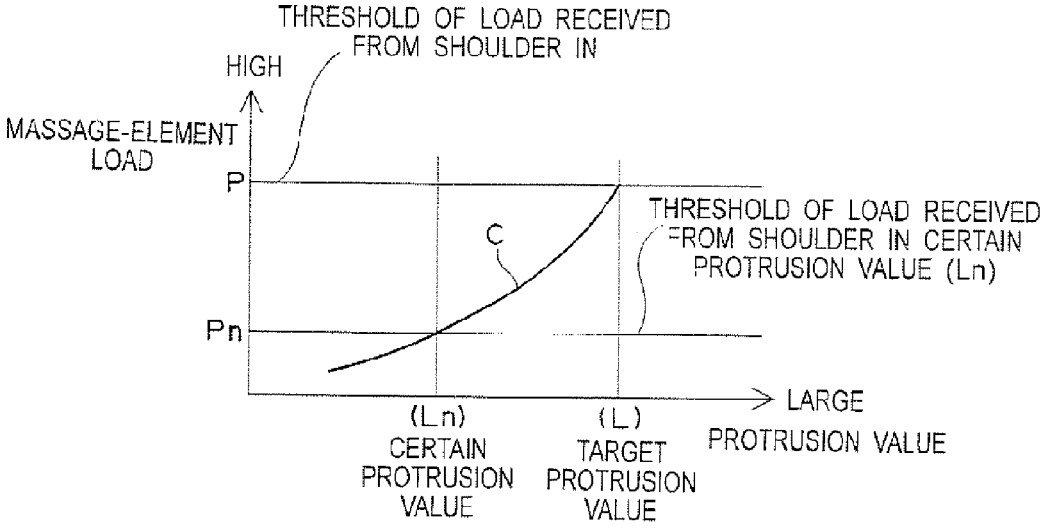
FIG. 4 is a graph showing a threshold of a load imposed on the massaging element from a user at a certain protrusion distance equal to or less than a target protrusion distance.

With reference to FIGS. 3A, 3B, and 4, the process of identifying a shoulder position will be more specifically described below. As mentioned above, in this massage chair S, after detecting (or recognizing) a shoulder position based on body-shape information, the massage element pair 1 is thrust at the detected shoulder position while measuring a massage-element load, so as to perform a determination on whether the detected shoulder position is the true shoulder position. Then, when the detected shoulder position is determined to be mismatched with the true shoulder position, the massaging unit 2 is vertically moved while measuring massage-element load, to identify the true shoulder position.

Specifically as indicated by the dotted lines in FIG. 3A, the massage element pair 1 is rollingly moved from a waist region toward a head region (from a lower region to an upper region along the back as indicated by the arrow β) to measure massage-element loads. Then, based on a load distribution curve as shown in FIG. 3B obtained by the measured massage-element loads, body-shape information of the user M is acquired, and a shoulder position in the first operation is detected.

Then, at the shoulder position detected by the first operation, the massaging-element thrust mechanism 8 thrusts the massage element pair 1 toward the user M as indicated by the solid line in FIG. 3A, and simultaneously the load measurement device 7 measures a massage-element load (pressure).

A curve C in FIG. 4 shows a correlation between a protrusion distance of the massage element pair 1 and a massage-element load (load threshold) under the condition that the massage element pair 1 is located at the true shoulder position. Specifically, under the condition that the massage element pair 1 is located at the true shoulder position, when the massage element pair 1 is gradually thrust by a target protrusion distance L, the massage-element load will be increased up to a target load threshold P along with an increase in protrusion distance of the massage element pair 1, as indicated by the curve C.

In the course of thrusting the massage element pair 1 toward the user M at the shoulder position detected by the first operation, if the massage-element load reaches the target load threshold P (a load threshold associated with the target protrusion distance L) when the massage element pair 1 is thrust by a certain protrusion distance Ln, the shoulder-position identification system 3 will determine that the shoulder position detected by the first operation is mismatched with the true shoulder position.

When the shoulder position detected by the first operation is determined to be mismatched with the true shoulder position as described above, a load (pressure) threshold Pn associated with the certain protrusion distance Ln under the condition that the massage element pair 1 is located at the true shoulder position is automatically calculated based on the curve C. Then, the massaging unit 2 is moved in a direction allowing the massaging-element load to be lowered (in the upward direction) while maintaining a protrusion distance of the massage element pair 1 at the certain protrusion distance Ln. This movement of the massaging unit 2 will be continued until the massage-element load is lowered to the load threshold Pn. That is, the massaging unit 2 is moved by activating only the vertical movement mechanism 6 without activating the massaging-element thrust mechanism 8.

Then, a position where the massage-element load becomes equal to the load threshold Pn is determined as the true shoulder position and fixed as an identified position by the shoulder-position identification section 3*c*. In the above manner, the process of detecting a shoulder position in the first operation and the process of identifying the shoulder position in the second operation can be continuously or successively performed. This makes it possible to exactly detect a shoulder position of the user M seated in the massage chair S.

In the process of thrusting the massage element pair 1 toward the user M at the shoulder position detected by the first operation, when the massage-element load reaches the target load threshold P at the target protrusion distance L, the shoulder position detected by the first operation is determined as the true shoulder position and fixed as an identified position by the shoulder-position identification section 3*c*.

Further, in the process of thrusting the massage element pair 1 toward the user M at the shoulder position detected by the first operation, if the massage-element load does not reach the target load threshold P even after the massage element pair 1 is thrust by the target protrusion distance L, it will be determined that the shoulder position detected by the first operation is mismatched with the true shoulder position, and the massage element pair 1 is located above the shoulder. In this case, the massaging unit 2 is moved downward by the vertical movement mechanism 6, while maintaining a protrusion distance of the massage element pair 1 at the target protrusion distance L. This movement of the massaging unit 2 will be continued until the massage-element load is increased up to the target load threshold P. A position where the massage-element load becomes equal to the target load threshold P is determined as the true shoulder position and fixed as an identified position by the shoulder-position identification section 3*c*.

As above, in the massage chair S according to the first embodiment, the true shoulder position of the user M is identified by the shoulder-position identification section 3*c*, and then a massage operation in the massage mode is performed based on the true shoulder position. Further, the previously acquired body-shape information is corrected based on the identified true shoulder-position information. This makes it possible to perform a massage operation in conformity to a real body shape and shoulder position of the user M.

Second Embodiment

With reference to FIG. 5, a second embodiment of the present invention will be described below. In the second embodiment, the massage element pair 1 is rollingly moved from the waist region toward the head region (from the lower region to the upper region along the back) to obtain body-shape information, and a shoulder position in a first operation is detected based on the body-shape information, in the same manner as that in the first embodiment. Successively, at the detected shoulder position, the massage element pair 1 is thrust while measuring a massage-element load.

Then, it is determined whether the detected shoulder position is a true shoulder position. If the detected shoulder position is determined to be mismatched with the true shoulder position, the massaging unit 2 will be vertically moved while measuring a massage-element load, so as to find the true shoulder position.

A specific process of identifying a shoulder position in the second embodiment will be described below. The control unit 5 includes a table representing a relationship between a specific protrusion distance of the massage element pair 1 and a load threshold associated with the specific protrusion distance, as shown in FIG. 5. The table illustrated in FIG. 5 has a target protrusion distance L by which the massage element pair 1 is to be maximally thrust when it is located at the true shoulder position, and a target load threshold P associated with the target protrusion distance L. Further, a plurality of specific protrusion distance L1, L2, L3, L4, - - - which gradually increase toward the target load threshold P, and a plurality of load (pressure) thresholds P1, P2, P3, P4 - - - each associated with a corresponding one of the specific protrusion distances, are pre-set in the table.

As mentioned above, in the second embodiment, the massage element pair 1 is rollingly moved from the waist region toward the head region (from the lower region to the upper region along the back) to obtain body-shape information, and a shoulder position in the first operation is detected based on the body-shape information, in the same manner as that in the first embodiment.

Successively, at the detected shoulder position, the massage element pair 1 is thrust toward the user M by the massaging-element thrust mechanism 8, while measuring a massage-element load using the load measurement device 7. In the event that the massage-element load reaches the target load threshold P when the massage element pair 1 is thrust by either one (hereinafter referred to as "halfway protrusion distance") of the specific protrusion distances L1, L2, L3, L4, - - - in the course of the above thrust operation, the shoulder position detected by the first operation is determined to be mismatched with the true shoulder position. Then, a load threshold associated with the halfway protrusion distance is derived from the table illustrated in FIG. 5. For example, if the massage-element load reaches the target load threshold P when the massage element pair 1 is thrust by the specific protrusion distance L2, the load threshold P2 associated with the specific protrusion distance L2 will be derived from the table. Then, the massaging unit 2 is moved in a direction allowing the massage-element load to be lowered (in the upward direction) while maintaining the halfway protrusion distance (e.g. L2).

This movement will be continued until the massage-element load is lowered to the load threshold (e.g. P2) associated with the halfway protrusion distance (e.g. L2). That is, the massaging unit 2 is moved by activating only the vertical movement mechanism 6, while deactivating the massaging-element thrust mechanism 8 to maintain the halfway protrusion distance. Then, a position where the massage-element load becomes equal to the load threshold associated with the halfway protrusion distance is determined as the true shoulder position and fixed as an identified position by the shoulder-position identification section 3*c*. In the second embodiment, through the second operation, the true shoulder position can be identified using the table representing the preset specific protrusion distances L1, L2, L3, L4, - - - and the load thresholds P1, P2, P3, P4, - - - associated with the respective specific protrusion distances. This makes it possible to identify a shoulder position in a simplified manner.

In the process of thrusting the massage element pair 1 toward the user M at the shoulder position detected by the first operation, when the massage-element load reaches the target load threshold P at the target protrusion distance L, the shoulder position detected by the first operation is determined as the true shoulder position and fixed as an identified position by the shoulder-position identification system 3.

Further, in the process of thrusting the massage element pair 1 toward the user M at the shoulder position detected by the first operation, if the massage-element load does not reach the target load threshold P even after the massage element pair 1 is thrust by the target protrusion distance L, it will be determined that the shoulder position detected by the first operation is mismatched with the true shoulder position, and the massage element pair 1 is located above the shoulder. In this case, the massaging unit 2 is moved downward by the vertical movement mechanism 6, while maintaining a protrusion distance of the massage element pair 1 at the target protrusion distance L. This movement of the massaging unit 2 will be continued until the massage-element load is increased up to the target load threshold P. A position where the massage-element load becomes equal to the target load threshold P is determined as the true shoulder position and fixed as an identified position by the shoulder-position identification section 3*c*.

As above, in the massage chair S according to the second embodiment, the true shoulder position of the user M is identified by the shoulder-position identification section 3*c*, and then a massage operation in the massage mode is performed based on the true shoulder position. Further, the previously acquired body-shape information is corrected based on the identified true shoulder-position information. This makes it possible to perform a massage operation in conformity to a real body shape and shoulder position of the user M.

Third Embodiment

With reference to FIGS. 6 to 9A, a third embodiment of the present invention will be described below. In the third embodiment, the massage element pair 1 is rollingly moved from the waist region toward the head region (from the lower region to the upper region along the back) to obtain body-shape information, and a shoulder position in a first operation is detected based on the body-shape information, in the same manner as that in the first embodiment. Successively, at the detected shoulder position, the massage element pair 1 is thrust while measuring a massage-element load. Then, it is determined whether the detected shoulder position is a true shoulder position. If the detected shoulder position is determined to be mismatched with the true shoulder position, the massaging unit 2 will be vertically moved while measuring a massage-element load, so as to find the true shoulder position.

A specific process of identifying a shoulder position in the third embodiment will be described below. In the third embodiment, the control unit 5 includes a table representing a relationship of a protrusion distance of the massage element pair 1, a load threshold associated with the protrusion distance, and a corrective vertical movement value of the massage element pair 1 associated with the protrusion distance, as shown in FIG. 6. The table illustrated in FIG. 6 has a plurality of specific protrusion distances L1 to L9 set such that respective values thereof increase stepwise or in a multistage manner. The control unit 5 is operable to control the massage element pair 1 in such a manner that a protrusion distance thereof is increased up to a target protrusion distance L through the specific protrusion distance L1 to L9 in a multistage manner at the shoulder position detected by the first operation or a corrected shoulder position. In the table illustrated in FIG. 6, the protrusion distance L9 corresponds to the target protrusion distance L.

In the table illustrated in FIG. 6, a plurality of pre-set thresholds P1 to P9 of load (or pressure) to be imposed on the massage element pair 1 from the shoulder of the user M are associated, respectively, with the specific protrusion distances L1 to L9. In the third embodiment, the load thresholds P1 to P9 are specifically set at values as shown in FIG. 6 (P 1=10 kg, P 2=15 kg, P 3=20 kg, P 4=25 kg, P 5=30 kg, P 6=35 kg, P 7=40 kg, P 8=45 kg, P 9=50 kg. Each of a plurality of corrective movement values Y1 to Y9 illustrated in FIG. 6 shows a value of vertical movement (corrective movement value) of the massage element pair 1 necessary for correction in the event that a massage-element load does not correspond to each of the load thresholds P1 to P9 when the massage element pair 1 is thrust by the specific protrusion distances L1 to L9 in a multistage manner.

As mentioned above, in the third embodiment, the massage element pair 1 is rollingly moved from the waist region toward the head region (from the lower region to the upper region along the back) to obtain body-shape information, and a shoulder position in the first operation is detected based on the body-shape information, in the same manner as that in the first embodiment. Successively, at the shoulder position detected by the first operation, the massage element pair 1 is thrust toward the user M by the massaging-element thrust mechanism 8, while measuring a massage-element load using the load measurement device 7. In this process, the massage element pair 1 is thrust toward the user M by the respective specific protrusion distances L1 to L9 in a multistage manner.

Specifically, the massage element pair 1 is firstly thrust by the specific protrusion distance L1. When the massage-element load at the specific protrusion distance L1 is less than the load threshold P1 (10 kg), the massage element pair 1 is thrust by the specific protrusion distance L2. If the massage-element load exceeds the load threshold P1 (10 kg), the massage unit 2 will be moved upward within the range of the corrective movement value Y1 to check the presence of a position where the massage-element load becomes equal to the load threshold P1 (10 kg). When there is a position where the massage-element load becomes equal to the load threshold P1 (10 kg), the massage element pair 1 is thrust by the specific protrusion distance L2 at the position.

When the massage-element load on the massage element pair 1 after being thrust by the specific protrusion distance L2 is less than the load threshold P2, the massage element pair 1 is thrust by the specific protrusion distance L3 at this position. If the massage-element load exceeds the load threshold P2 (15 kg), the massage unit 2 will be moved upward within the range of the corrective movement value Y2 to check whether there is a position where the massage-element load becomes equal to the load threshold P2 (15 kg). When there is a position where the massage-element load becomes equal to the load threshold P2 (15 kg), the massage element pair 1 is thrust by the specific protrusion distance L3 at this position.

Figure 7:
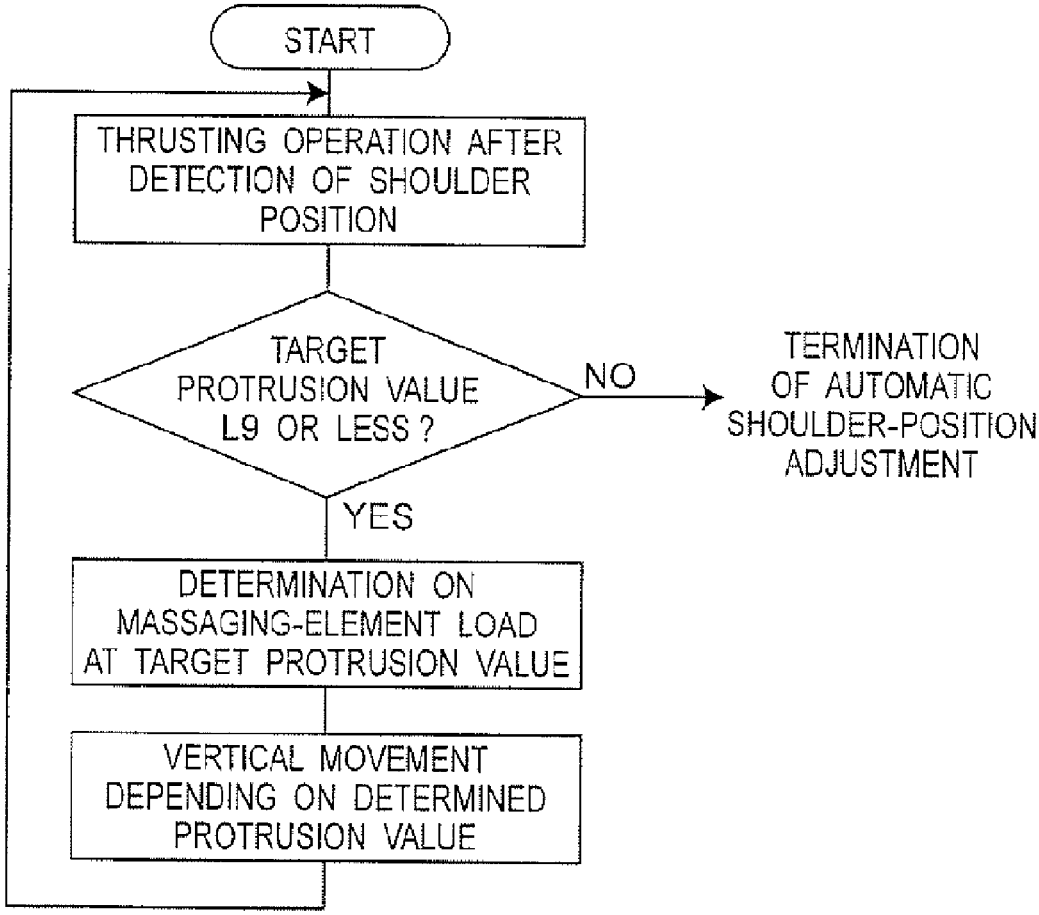
FIG. 7 is a flowchart showing a shoulder-position adjusting process.

In this manner, the operation of checking whether there is a position capable of obtaining the load threshold associated with each of the specific protrusion distances is repeatedly performed stepwise at the respective specific protrusion distances L1 to L9, as schematically shown in FIG. 7. Finally, a position where the massage element pair 1 is thrust by the target protrusion distance L9 (=L) and the massage-element load is equal to the target load threshold P9 (=P=50 kg) is found out. This position is determined as the true shoulder position and fixed as an identified position by the shoulder-position identification section 3*c*.

In the event that no position where the massage-element load becomes equal to each of the load thresholds P1 to P9 even if the massaging unit 2 is moved upward within each range of the corrective movement values Y1 to Y9 is found out, the shoulder-position identification operation is terminated.

FIGS. 8A, 8B, 8C, 9A and 9B show one modification of the massage chair of the present invention, which includes a fork-shaped massaging arm 4 having branched upper and lower arms 4*a*, 4*b*. In this massage chair, one massaging element 1 is attached to a distal end of the upper arm 4*a*, and the other massaging element 1' is attached to a distal end of the lower arm 4*b*. The massaging arm 4 has a base end rotatably attached to the massaging unit 2. In this modification, when the massaging arm 4 is rotated as indicated by the arrow J1 in FIG. 8A, the massaging element 1 attached to the distal end of the upper arm 4*a* is thrust toward the user M while being rotated as indicated by the arrow J1.

Figure 9A:
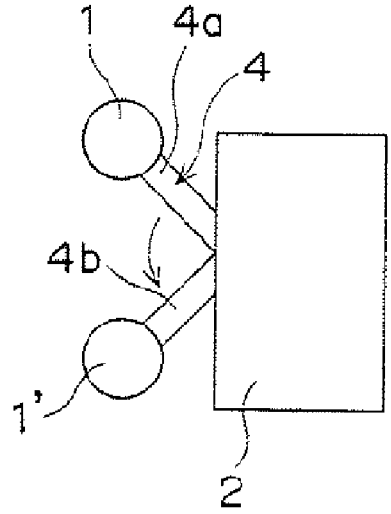
FIG. 9A is an explanatory diagram showing the fact that a vertical position of a massaging unit is not changed even though a vertical position of the massaging element is changed, in the mechanism adapted to rotate the fork-shaped massaging arm so as to thrust the massaging element.
Figure 9B:
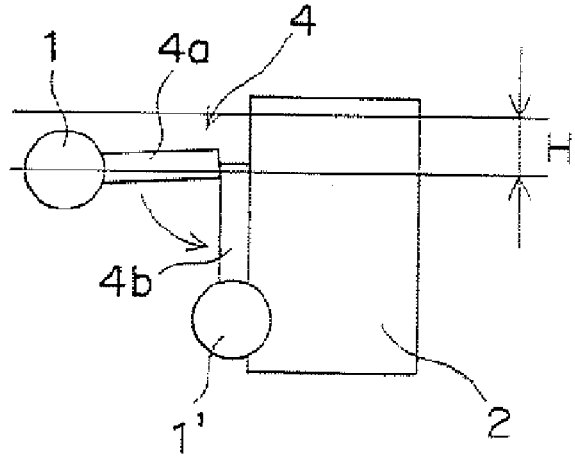
FIG. 9B is an explanatory diagram showing the fact that a vertical position of a massaging unit is not changed even though a vertical position of the massaging element is changed, in the mechanism adapted to rotate the fork-shaped massaging arm so as to thrust the massaging element.

During the above movement, the massaging element 1 is rotated to draw an arc. Thus, in addition to the thrust movement toward the user M, the massaging element 1 is moved to a lower position along with the thrust movement, as shown in FIGS. 9A and 9B. However, a vertical position of the massaging unit 2 is not changed. Specifically, when the massaging element 1 is thrust by a rotation from a position illustrated in FIG. 9A to a position illustrated in FIG. 9B, the position of the massaging element 1 is lowered by H. In contrast, the vertical position of the massaging unit 2 illustrated in each of FIGS. 9A and 9B is not changed.

Figure 8A:
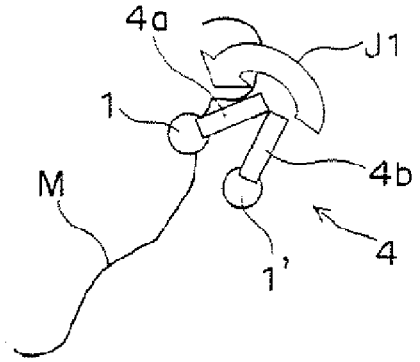
FIG. 8A is a diagram showing a state when a fork-shaped massaging arm is being rotated to thrust a massaging element, in a mechanism adapted to rotate the fork-shaped massaging arm so as to thrust the massaging element.
Figure 8B:
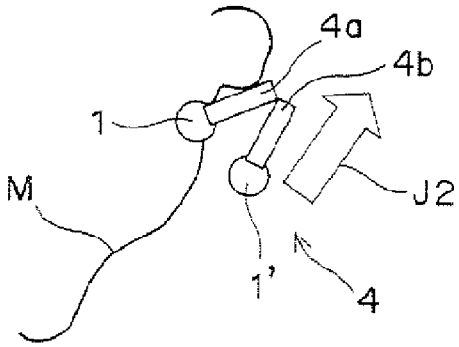
FIG. 8B is a diagram showing a state when the massaging element is being moved upward, in the mechanism adapted to rotate the fork-shaped massaging arm so as to thrust the massaging element.
Figure 8C:
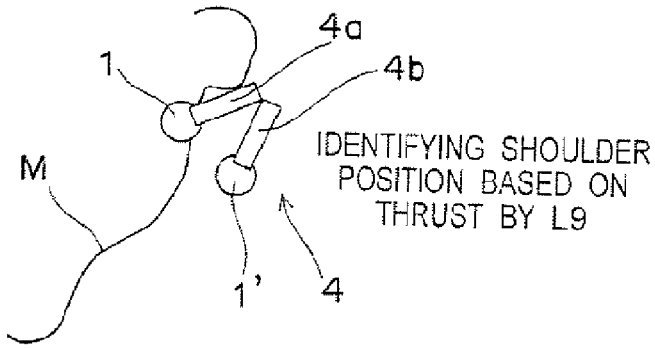
FIG. 8C is a showing state after the massaging elements is thrust by a target protrusion distance to allow a shoulder position to be identified, in the mechanism adapted to rotate the fork-shaped massaging arm so as to thrust the massaging element.

Thus, in a mechanism adapted to detect the vertical position the massaging unit 2 so as to determine a shoulder position, a certain deviation between determined and true shoulder positions occurs due to the downward displacement of the massaging element 1 in conjunction with the thrust movement of the massaging element 1. In this respect, the massaging chair according to the third embodiment is designed to thrust the massaging element 1 by the respective specific protrusion distances L1 to L9 (L9=target protrusion distance L) in a multistage manner, while moving the massaging unit 2 as indicated by the arrow J2 in FIG. 8B so as to allow the massage-element load to be equal to each of the load thresholds P1 to P9 associated, respectively, with the specific protrusion distances L1 to L9 and finally thrust the massaging element 1 by the respective specific protrusion distance L9 (L) so as to find a position where the massage-element load becomes equal to the target load threshold P associated with the final protrusion distance L9, as shown in FIG. 8C. Thus, the true shoulder position can be identified without occurrence of the deviation.

While the present invention has been described in conjunction with specific embodiments thereof, various modifications and alterations will become apparent to those skilled in the art. Therefore, it is intended that the present invention is not limited to the illustrative embodiments herein, but only by the appended claims and their equivalents.

As mentioned above, the massage chair of the present invention is useful as means capable of adequately giving a massage, particularly, to the shoulder region of a user, and suitable for use as a massaging apparatus in acupuncture centers, sports facilities or the like.

The invention claimed is:

1. A massage chair adapted to give a massage to a user comprising:

a massaging element attached to a vertically movable massaging unit;

a body-shape-information acquisition section for acquiring body-shape information of the user based on loads imposed on said massaging element from respective regions of the user when said massaging unit is vertically moved in a first operation;

a shoulder-position detection section for detecting a shoulder position of the user based on said body-shape information; and a shoulder-position identification section to thrust with forward pushing movement said massaging element in a direction toward the user at said detected shoulder, position while measuring a load imposed on said massaging element in a second operation, so as to determine, based on said measured load, whether the detected shoulder position is a true shoulder position, and, when the detected shoulder position is determined to be mismatched with said true shoulder position, to vertically move said massaging unit while re-measuring the load imposed on said massaging element in the second operation, so as to identify said true shoulder position based on said re-measured load, wherein said body-shape information is corrected based on the shoulder position identified by said shoulder-position identification section, and wherein the massage chair gives the massage to the user based on the identified shoulder position and the corrected body-shape information.

2. The massage chair as defined in claim 1, wherein said shoulder-position identification section is designed to continuously thrust with forward pushing movement said massaging element in the direction toward the user for a target protrusion distance at the detected shoulder position, wherein said shoulder-position identification section is operable, in the event that the load imposed on said massaging element in the course of said continuous thrust operation reaches a load threshold associated with said target protrusion distance at said true shoulder position, to move said massaging unit upward while maintaining a protrusion distance at the time of said event, and identify, as said true shoulder position, a position where the load imposed on said massaging element is lowered to a load threshold associated with said maintained protrusion distance at said true shoulder position.

3. The massage chair as defined in claim 1, wherein said shoulder-position identification section is designed to thrust with forward pushing movement said massaging element in the direction toward the user for a target protrusion distance at the detected shoulder position in a multistage manner according to a plurality of specific protrusion distances pre-set such that respective values thereof increase in plural stages and include said target protrusion distance as a maximum value, wherein said shoulder-position identification section is operable, in the event that the load imposed on said massaging element in the course of said multistage thrust operation exceeds a load threshold associated with said target protrusion distance at said true shoulder position, to move said massaging unit upward while maintaining the specific protrusion distance in the stage having said event, and identify, as said true shoulder position, a position where the load imposed on said massaging element is lowered to a load threshold associated with said maintained specific protrusion distance at said true shoulder position.

4. The massage chair as defined in claim 1, wherein said shoulder-position identification section is designed to thrust with forward pushing movement said massaging element by each of a plurality of specific protrusion distances in plural stages to be changed from a first stage to a last stage, said plurality of specific protrusion distances being pre-set such that respective values thereof increase in plural stages and include said target protrusion distance as a maximum value, wherein said shoulder-position identification section is operable, when the load imposed on said massaging element in a certain one of said stages is equal to or less than a load threshold associated with the specific protrusion distance in said certain stage, to thrust with forward pushing movement said massaging element by the specific protrusion distance in a next one of said stages, and, in the event that the load imposed on said massaging element in a certain one of said stages exceeds a load threshold associated with the specific protrusion distance in said certain stage, to move said massaging unit upward to a position where the load imposed on said massaging element is lowered to said load threshold associated with the specific protrusion distance in said certain stage, and then thrust with forward pushing movement said massaging element by the specific protrusion distance in a next one of said stages, and wherein said shoulder-position identification section is operable to identify, as said true shoulder position, a position where the load imposed on said massaging element thrust by said target protrusion distance is equal to a load threshold associated with said target protrusion distance at said true shoulder position.

* * * * *